US011662676B2

(12) United States Patent
Kanada et al.

(10) Patent No.: US 11,662,676 B2
(45) Date of Patent: May 30, 2023

(54) IMAGE FORMING APPARATUS AND CONTROL METHOD

(71) Applicant: BROTHER KOGYO KABUSHIKI KAISHA, Nagoya (JP)

(72) Inventors: Soun Kanada, Iwakura (JP); Yuki Fukusada, Nagoya (JP); Tatsuya Koyama, Toyoake (JP); Kotaro Fujishiro, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/748,353

(22) Filed: May 19, 2022

(65) Prior Publication Data

US 2022/0373943 A1 Nov. 24, 2022

(30) Foreign Application Priority Data

May 21, 2021 (JP) ..... JP2021-086030
Dec. 10, 2021 (JP) ..... JP2021-200661
Apr. 22, 2022 (JP) ..... JP2022-070648

(51) Int. Cl.
*G03G 15/20* (2006.01)
*G03G 15/00* (2006.01)
*G03G 15/01* (2006.01)

(52) U.S. Cl.
CPC ..... *G03G 15/205* (2013.01); *G03G 15/01* (2013.01); *G03G 15/50* (2013.01)

(58) Field of Classification Search
CPC ..... G03G 15/01; G03G 15/50; G03G 15/205
USPC ..... 399/67, 69, 70
See application file for complete search history.

(56) References Cited

U.S. PATENT DOCUMENTS 10,838,331 B1 * 11/2020 Ishii ..... G03G 15/206

FOREIGN PATENT DOCUMENTS

JP 2004-291243 A1 10/2004
JP 2015-69039 A1 4/2015
JP 2019133069 * 8/2019

* cited by examiner

*Primary Examiner* — Hoan H Tran
(74) *Attorney, Agent, or Firm* — Merchant & Gould P.C.

(57) ABSTRACT

In an image forming apparatus, upon receipt of a printing instruction, a controller starts rotation of a heating member, starts rotation of a photoconductor drum when a standby time has elapsed from a time of the start of the rotation of the heating member, starts conveyance of a sheet after the start of the rotation of the photoconductor drum, and forms a toner image on the sheet after the start of the conveyance of the sheet. The controller is configured to be operated in one of selectable modes including a multicolor mode in which a toner image is formed using both of toner of a first color and a second color and a monochrome mode in which a toner image is formed using toner of the second color only. The standby time adopted in the monochrome mode is longer than the standby time adopted in the multicolor mode.

10 Claims, 7 Drawing Sheets

IMAGE FORMING APPARATUS AND CONTROL METHOD

CROSS-REFERENCE TO RELATED APPLICATION(S)

This application claims priority from Japanese Patent Application No. 2021-086030 filed on May 21, 2021, Japanese Patent Application No. 2021-200661 filed on Dec. 10, 2021, and Japanese Patent Application No. 2022-070648 filed on Apr. 22, 2022, the disclosures of which are incorporated herein by reference in their entirety.

TECHNICAL FIELD

This disclosure relates to an image forming apparatus with a controller for controlling rotations of a photoconductor drum and a heating member, and a method of control implemented therein.

BACKGROUND ART

An image forming apparatus may include a controller capable of executing a preliminary (pre-process) rotation process of causing a photoconductor drum to make a predetermined number of (or more) rotations while causing a charger to operate, for a period of time after receipt of a printing instruction before start of feed of a first sheet, so as to stabilize a surface potential of the photoconductor drum. In this technical scheme, typically, a fuser motor is activated to start rotation of a heating roller (heating member) at a time when the temperature of a fuser assembly has reached a fuser motor rotation permissible temperature after receiving a printing instruction, and thereafter, a process motor is activated to start the preliminary rotation process (to start rotation of the photoconductor drum) at a time when the temperature of the fuser assembly has reached a process motor rotation permissible temperature. After activating the process motor, a laser diode for exposure of the photoconductor drum is caused to emit light, and after the output of the laser diode is stabilized, a sheet feed is started, so that a sheet is fed after the temperature of the fuser assembly has reached an image quality assurance temperature.

SUMMARY

Determination of sheet feed timing based on activation of the process motor depending upon the temperature of the fuser assembly would be subject to variation by the influence of the ambient temperature or the temperatures of the heating roller or the like at the time of receipt of the printing instruction. On the other hand, the preliminary rotation process is not affected by the influence of temperatures and performed for a fixed period as predetermined.

For adequate printing, the preliminary rotation process should be completed after receipt of the printing instruction before the leading edge of the first sheet arrives at the photoconductor drum. On this account, the start of the preliminary rotation process may be set at an earlier time with allowance made for the variation of the sheet feed timing to ensure that the preliminary rotation process is completed before the leading edge of the first sheet arrives at the photoconductor drum. However, setting such an earlier time for starting the preliminary rotation process would result in unnecessary rotation of the photoconductor drum between the time of completion of the preliminary rotation process and the arrival of the leading edge of the first sheet at the photoconductor drum.

There is a need to obviate unnecessary rotation the photoconductor drum would make after receipt of the printing instruction before the leading edge of the first sheet arrives at the photoconductor drum.

In one aspect, an image forming apparatus comprising a sheet feed mechanism, a conveyor belt, a first photoconductor drum, a second photoconductor drum, a heating member, and a controller is disclosed herein. The sheet feed mechanism is provided to feed a sheet. The conveyor belt is provided to convey the sheet fed by the sheet feed mechanism in a direction of conveyance of the sheet. The first photoconductor drum is provided to form a toner image of a first color on the sheet conveyed by the conveyor belt. The second photoconductor drum is provided to form a toner image of a second color on the sheet conveyed by the conveyor belt. The second photoconductor drum is located downstream of the first photoconductor drum in the direction of conveyance of the sheet. The heating member is configured to heat a sheet, the heating member being rotatable. The controller is configured to be operated in one of selectable modes including a multicolor mode in which a toner image is formed using both of toner of the first color and toner of the second color and a monochrome mode in which a toner image is formed using toner of the second color only. The controller is configured to exercise, upon receipt of a printing instruction, control which comprises: starting rotation of the heating member; starting rotation of the first and second photoconductor drums when a first standby time has elapsed from a time of the starting of the rotation of the heating member if the controller is operated in the monochrome mode, or when a second standby time longer than the first standby time has elapsed from the time of the starting of the rotation of the heating member if the controller is operated in the multicolor mode; causing the sheet feed mechanism to feed a sheet after the starting of the rotation of the first and second photoconductor drums; and forming a toner image on the sheet after causing the sheet feed mechanism to feed the sheet. The standby time adopted when the controller is operated in the multicolor mode is longer than the standby time adopted when the controller is operated in the monochrome mode.

In another aspect, an image forming apparatus comprising a photoconductor drum, a heating member, and a controller is disclosed herein. The photoconductor drum is provided to form a toner image on a sheet. The heating member is configured to heat a sheet, and comprises a heating roller that is rotatable. The controller is configured to execute, upon receipt of a printing instruction, processes comprising a heating process, a pre-fixing rotation process, a pre-process rotation process, and a sheet feed process. The heating process is a process of heating the heating roller. The pre-fixing rotation process is a process of starting rotation of the heating roller and causing the heating roller to rotate for a first execution period TMp from a time of the starting of the rotation of the heating roller. The pre-process rotation process is a process of starting rotation of the photoconductor drum when a standby time TMw has elapsed from the time of the starting of the rotation of the heating roller and causing the photoconductor drum to rotate for a second execution period TMd from a time of starting of rotation of the photoconductor drum. The second execution period TMd is shorter than the first execution period TMp. The sheet feed process is a process of starting feed of a sheet if both of a first condition and a second condition are satisfied where the first condition is satisfied if the pre-fixing rotation process has been completed, and the second condition is satisfied if a temperature of the heating roller has become equal to or higher than a predetermined temperature. The standby time TMw satisfies an equation:

$$TMw=(TMp+TMf)-TMd$$

where TMf is a time period from a time of the starting of the feed of the sheet until a leading edge of the sheet arrives at the photoconductor drum.

In still another aspect, a method of control implemented in an image forming apparatus including a sheet feed mechanism provided to feed a sheet, a conveyor belt provided to convey the sheet fed by the sheet feed mechanism in a direction of conveyance of the sheet, a first photoconductor drum provided to form a toner image of a first color on the sheet conveyed by the conveyor belt, a second photoconductor drum provided to form a toner image of a second color on the sheet conveyed by the conveyor belt, and a heating member configured to heat a sheet is disclosed herein. The second photoconductor drum is located downstream of the first photoconductor drum in the direction of conveyance of the sheet. The heating member is rotatable. The control is exercised in one of selectable modes including a multicolor mode in which a toner image is formed using both of toner of the first color and toner of the second color and a monochrome mode in which a toner image is formed using toner of the second color only. The method to be executed upon receipt of a printing instruction comprises: starting rotation of the heating member; starting rotation of the first and second photoconductor drums when a first standby time has elapsed from a time of the starting of the rotation of the heating member if the controller is operated in the monochrome mode, or when a second standby time longer than the first standby time has elapsed from the time of the starting of the rotation of the heating member if the controller is operated in the multicolor mode; causing the sheet feed mechanism to feed a sheet after the starting of the rotation of the first and second photoconductor drums; and forming a toner image on the sheet after causing the sheet feed mechanism to feed the sheet.

BRIEF DESCRIPTION OF THE DRAWINGS

The above and other aspects, their advantages and further features will become more apparent by describing in detail illustrative, non-limiting embodiments thereof with reference to the accompanying drawings, in which:

FIG. 3 is a schematic diagram showing paths of transmission of driving forces of motors or the like;

DESCRIPTION OF EMBODIMENTS

Figure 1:
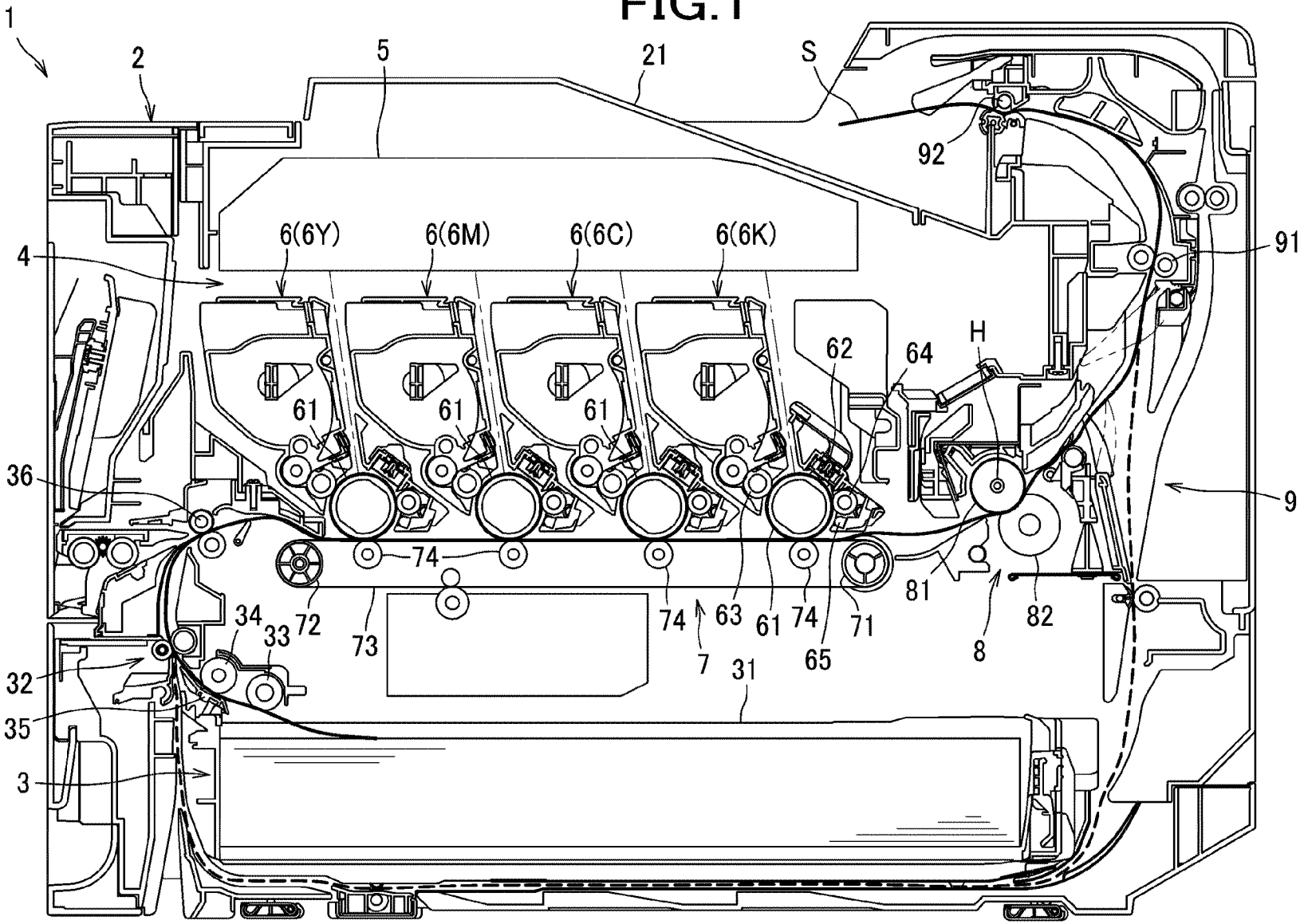
FIG. 1 is a section view of a color printer.

As shown in FIG. 1, a color printer 1 as an example of an image forming apparatus includes a housing 2, a sheet feeder unit 3, an image forming unit 4, a fixing device 8, and a conveyor unit 9. The housing 2 includes a sheet output tray 21 provided in an upper surface thereof.

The sheet feeder unit 3 is provided in a lower space inside the housing 2, and includes a sheet feed tray 31 configured as a receptacle to hold and serve sheets S, and a sheet feed mechanism 32 configured to feed a sheet S held in the sheet feed tray 31, to the image forming unit 4. The sheet feed mechanism 32 includes a pickup roller 33, a separation roller 34, a separation pad 35, and a registration roller 36.

In the sheet feeder unit 3, sheets S in the sheet feed tray 31 are fed by the pickup roller 33 toward the separation roller 34, and separated one from the others between the separation roller 34 and the separation pad 35. The registration roller 36 aligns the edge of the sheet S and conveys the sheet S toward the image forming unit 4.

The image forming unit 4 includes an exposure device 5, four process units 6, and a transfer unit 7.

The exposure device 5 is provided in an upper space inside the housing 2, and includes a light source, a polygon mirror and other components which are not illustrated. The exposure device 5 is configured to scan a surface of each photoconductor drum 61 with a light beam, to thereby expose the surface of the photoconductor drum 61 to the light beam.

Each of the four process units 6 includes a photoconductor drum 61, a charger 62, a development roller 63, a drum cleaner 64, and a static eliminator lamp 65. The drum cleaner 64 is configured to clean the surface of the corresponding photoconductor drum 61, and the static eliminator lamp 65 is configured to irradiate the surface of the corresponding photoconductor drum 51 with light to thereby eliminate static electricity. Each of the four process units 6 contains, in its inside space, toner as an example of a developer.

The process units 6 containing toner of respective colors of yellow, magenta, cyan, and black, as designated by reference characters 6Y, 6M, 6C, and 6K, respectively, are arranged in this sequence in a direction of conveyance of a sheet S. In the following description and associated drawings, when the photoconductor drums 51, the development rollers 61 or other members are specified for respective colors of toner, signs of Y, M, C, and K are appended to reference numerals of the respective members for yellow, magenta, cyan, and black.

Figure 2:
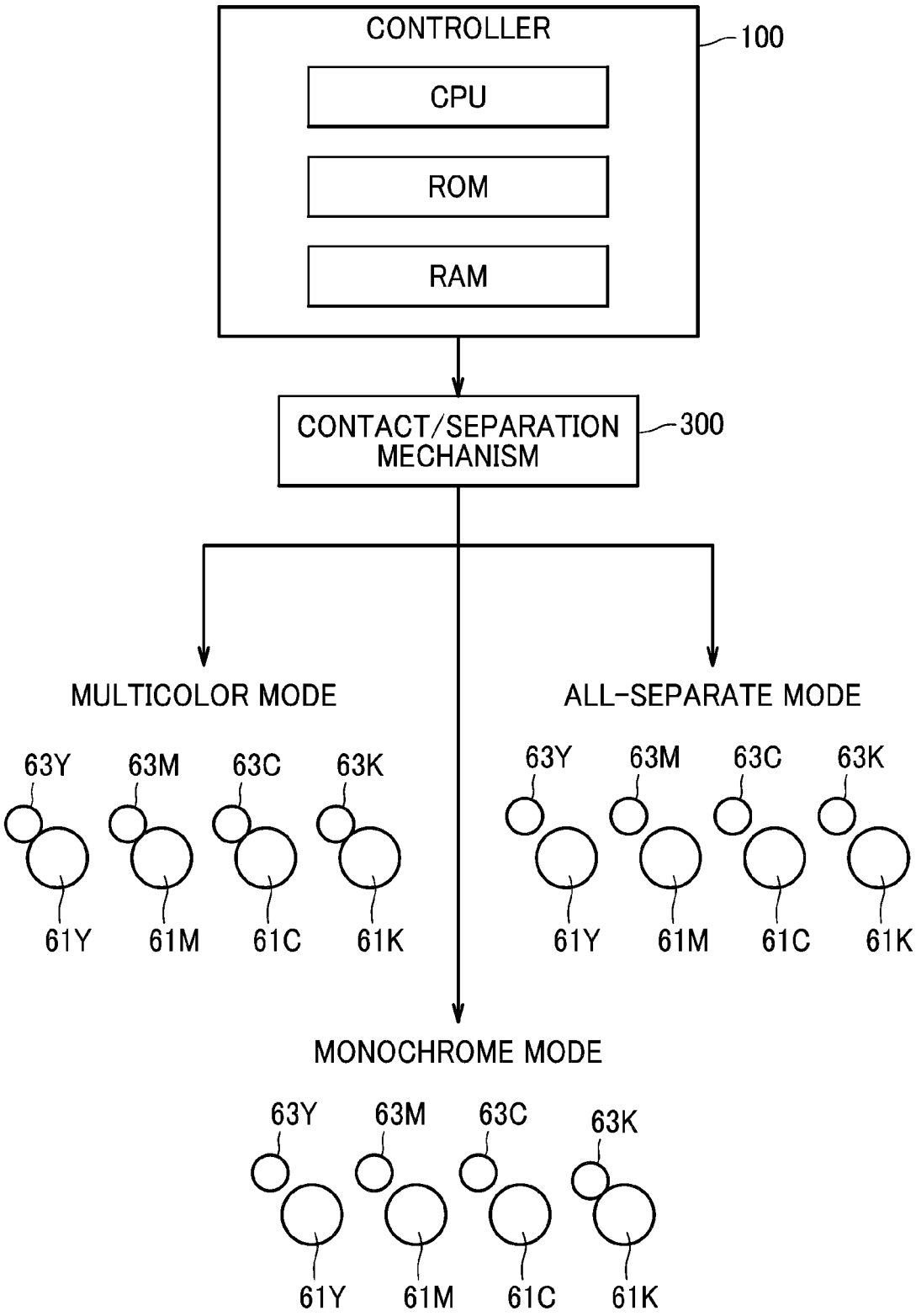
FIG. 2 is a schematic diagram for explaining contact/separation states of photoconductor drums and development rollers.

As shown in FIG. 2, the development roller 63 is movable between a contact position in which the development roller 63 is in contact with the photoconductor drum 61 and a separate position in which the development roller 63 is separate from the photoconductor drum 61. The color printer 1 further includes a contact/separation mechanism 300 and a controller 100. The contact/separation mechanism 300 is a mechanism that causes the development roller 63 to move between the contact position and the separate position. The controller 100 includes a central processing unit (CPU), a read-only memory (ROM), a random access memory (RAM), etc., and is configured to execute various processes, in response to receipt of a printing instruction, or the like, according to programs prepared in advance.

The controller 100 is configured to be operated in one of selectable modes including a multicolor mode in which a toner image is formed using toner of a plurality of colors, a monochrome mode in which a toner image is formed using toner of a single color, and an all-separate mode in which all the development rollers 63 are separated from the corresponding photoconductor drums 61. To switch the modes, the controller 100 causes the contact/separation mechanism 300 to operate to move one or more of the development rollers 63. In the multicolor mode, all the development rollers 63 are kept in contact with the corresponding photoconductor drums 61. In the monochrome mode, only the development roller 63K for black is kept in contact with the corresponding photoconductor drum 61K, and the other three development rollers 63Y, 63M, 63C for yellow, magenta, and cyan are kept out of contact with the corresponding photoconductor drums 61Y, 61M, 61C. In the all-separate mode, all the development rollers 63 are kept out of contact with the corresponding photoconductor drums 61. The all-separate mode is adopted, for example, when the photoconductor drums 61 are subject to cleaning.

In the following description, "first" will be prefixed to the legends of members to be used in the multicolor mode and not to be used in the monochrome mode, which are specified with signs of Y, M and C appended to their reference numerals, and "second" will be prefixed to the legends of members to be used in both of the multicolor mode and the monochrome mode, which are specified with a sign of K appended to their reference numerals, as the case may be. For example, the photoconductor drums 61Y, 61M and 61C may be expressed as the first photoconductor drums 61Y, 61M and 61C. Similarly, the photoconductor drums 61K may be expressed as the second photoconductor drum 61K.

As shown in FIG. 1, the transfer unit 7 includes a drive roller 71, a follower roller 72, a conveyor belt 73, and four transfer rollers 74. The conveyor belt 73 is an endless belt, and stretched between and looped over the drive roller 71 and the follower roller 72. Inside the conveyor belt 73, the transfer rollers 74 are located in positions corresponding to the photoconductor drums 61. The conveyor belt 73 is nipped between the transfer rollers 74 and corresponding photoconductor drums 61.

The charger 62 is a member that charges a surface of the corresponding photoconductor drum 61. In other words, for example, the first charger 62Y charges a surface of the first photoconductor drum 61Y. The second charger 62K charges a surface of the second photoconductor drum 61K. The exposure device 5 exposes the charged surface of each photoconductor drum 61 to light, and an electrostatic latent image as formulated according to image data is formed on the surface of the photoconductor drum 61.

The development roller 63 is a member that supplies toner to an electrostatic latent image formed on the corresponding photoconductor drum 61. Thus, a toner image is formed on the photoconductor drum 61. Thereafter, a sheet S is conveyed to an interface between the photoconductor drum 61 and the corresponding transfer roller 74, and the toner image on the photoconductor drum 61 is transferred to the sheet S.

The fixing device 8 is a device configured to thermally fix a toner image on a sheet S. The fixing device 8 includes a heating roller 81 configured to heat a sheet S, and a pressure roller 82 configured to nip a sheet S in combination with the heating roller 81. The heating roller 81 has a shape of a circular cylinder, and contains a heater H in its cylindrical inside space. The pressure roller 82 is pressed against the heating roller 81, and configured to rotate by following the rotational motion of the rotating heating roller 81.

The conveyor unit 9 is, principally, configured to convey a sheet S outputted from the fixing device 8 toward the outside of the housing 2. The conveyor unit 9 mainly includes a conveyor roller 91, and an output roller 92. A sheet S outputted from the fixing device 8 is conveyed by the conveyor roller 91 to the output roller 92, and ejected by the output roller 92 onto the sheet output tray 21.

Figure 3:
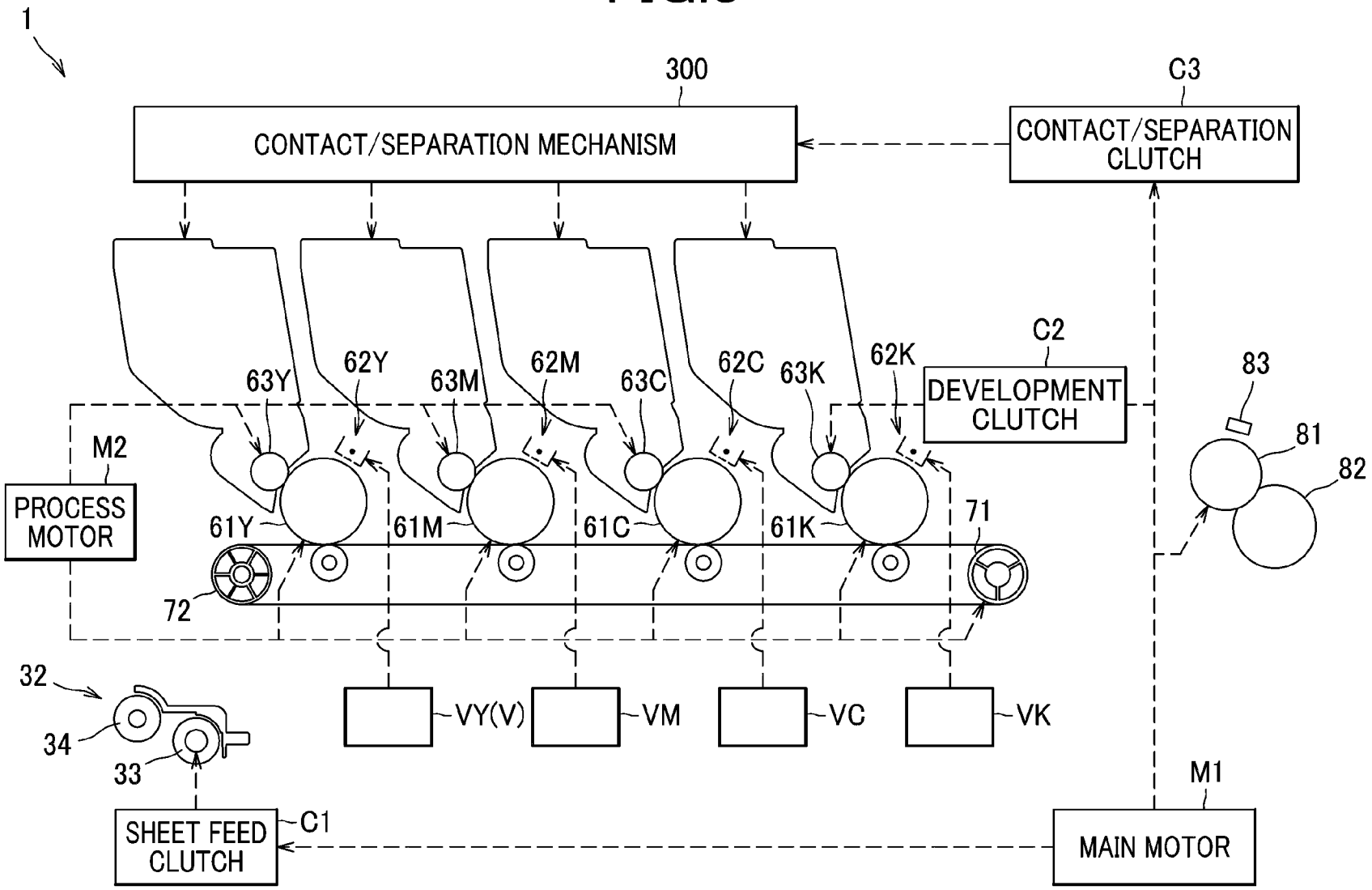

As shown in FIG. 3, the color printer 1 further includes a main motor M1 as an example of a first motor, a process motor M2 as an example of a second motor, a sheet feed clutch C1, a development clutch C2, a contact/separation clutch C3, charging bias supply circuits V, and a temperature sensor 83.

The main motor M1 is a motor that supplies driving force to the sheet feed mechanism 32, the heating roller 81, the development roller 63K (i.e., second development roller 63K for black color, for use in the monochrome mode and the multicolor mode), and the contact/separation mechanism 30. The main motor M1 is connected via gearing (not shown) and the sheet feed clutch C1 to the pickup roller 33. The sheet feed clutch C1 is a clutch capable of switching between an engagement state in which a driving force of the main motor M1 is transmitted to the pickup roller 33 and a disengagement state in which transmission of the driving force from the main motor M1 to the pickup roller 33 is interrupted.

The main motor M1 is connected via gearing (not shown) to the heating roller 81. The main motor M1 is connected via gearing (not shown) and the development clutch C2 to the development roller 63K. The development clutch C2 is a clutch capable of switching between an engagement state in which the driving force of the main motor M1 is transmitted to the development roller 63K and a disengagement state in which transmission of the driving force from the main motor M1 to the development roller 63K is interrupted.

The main motor M1 is connected via gearing (not shown) and the contact/separation clutch C3 to the contact/separation mechanism 300. The contact/separation clutch C3 is a clutch capable of switching between an engagement state in which the driving force of the main motor M1 is transmitted to the contact/separation mechanism 300 and a disengagement state in which transmission of the driving force from the main motor M1 to the contact/separation mechanism 300 is interrupted.

The process motor M2 is a motor that supplies driving force to the development rollers 63Y, 63M and 63C (i.e., first development rollers for yellow, magenta and cyan, for use in the multicolor mode), the four photoconductor drums 61, and the drive roller 71. The process motor M2 is connected via gearing (not shown) to the three development rollers 63Y, 63M and 63C, the four photoconductor drums 61, and the drive roller 71.

The charging bias supply circuit V is a circuit that provides a charging bias to the charger 62. Four charging bias supply circuits V are provided one for each of the four chargers 62. For example, the first charging bias supply circuit VY for yellow color, (i.e., one of the three first charging bias supply circuits V) is provided for the first charger 62Y, and the second charging bias supply circuit VK is provided for the second charger 62K.

The temperature sensor 83 is a sensor configured to detect a temperature of the heating roller 81. The temperature detected by the temperature sensor 83 is provided to the controller 100.

The controller 100 is configured to execute, after receipt of instruction, several processes which include a heating process, a pre-fixing rotation process, a pre-process rotation process and a sheet feed process. The heating process is a process of heating the heating roller 81. More specifically, in the heating process, the heating roller 81 is heated by the heater H to increase the temperature of the heating roller 81 to a fixing temperature To (see also FIG. 6). To start the heating process, the controller 100 activates the heater H before activating the main motor M1. The pre-fixing rotation process is a process of rotating the heating roller 81 and the pressure roller 82 before starting an image forming process for making the conditions of the heating roller 81 and the pressure roller 82 suitable for the fixing process. To be more specific, the pre-fixing rotation process is a process of starting rotation of the heating roller 81 and causing the heating roller 81 to rotate for a first execution period TMp from a time of the starting of the rotation of the heating roller 81. To start the pre-fixing rotation process, the controller 100 activates the main motor M1 before activating the process motor M2.

The controller 100 is configured to change the first execution period TMp according to an ambient temperature, and a type of a sheet S. Specifically, the controller 100 sets the first execution period TMp on the basis of a first table stored in a memory such as RAM. The first table contains information of several parameters including the ambient temperatures and the types of a sheet S, each combination of which is associated with the first execution period TMp, showing a relationship between each combination of the parameters and the first execution period TMp.

The lower the ambient temperature, the longer the first execution period TMp the controller 100 sets. The thicker the thickness of the sheet S and the larger the area of the sheet S, the longer the first execution period TMp the controller 100 sets.

The pre-process rotation process is a process of rotating the photoconductor drums 61 and the like before starting the image forming process for making the conditions of the photoconductor drums 61 or the like suitable for the image forming process. To be more specific, the pre-process rotation process is a process of starting rotation of the photoconductor drums 61 and causing the photoconductor drums 61 to rotate for a second execution period TMd from a time of starting the rotation of the photoconductor drums 61. In the pre-process rotation process, the photoconductor drums 61 are caused to rotate while the chargers 62 are being operated. To start the pre-process rotation process, the controller 100 activates the process motor M2.

Figure 6:
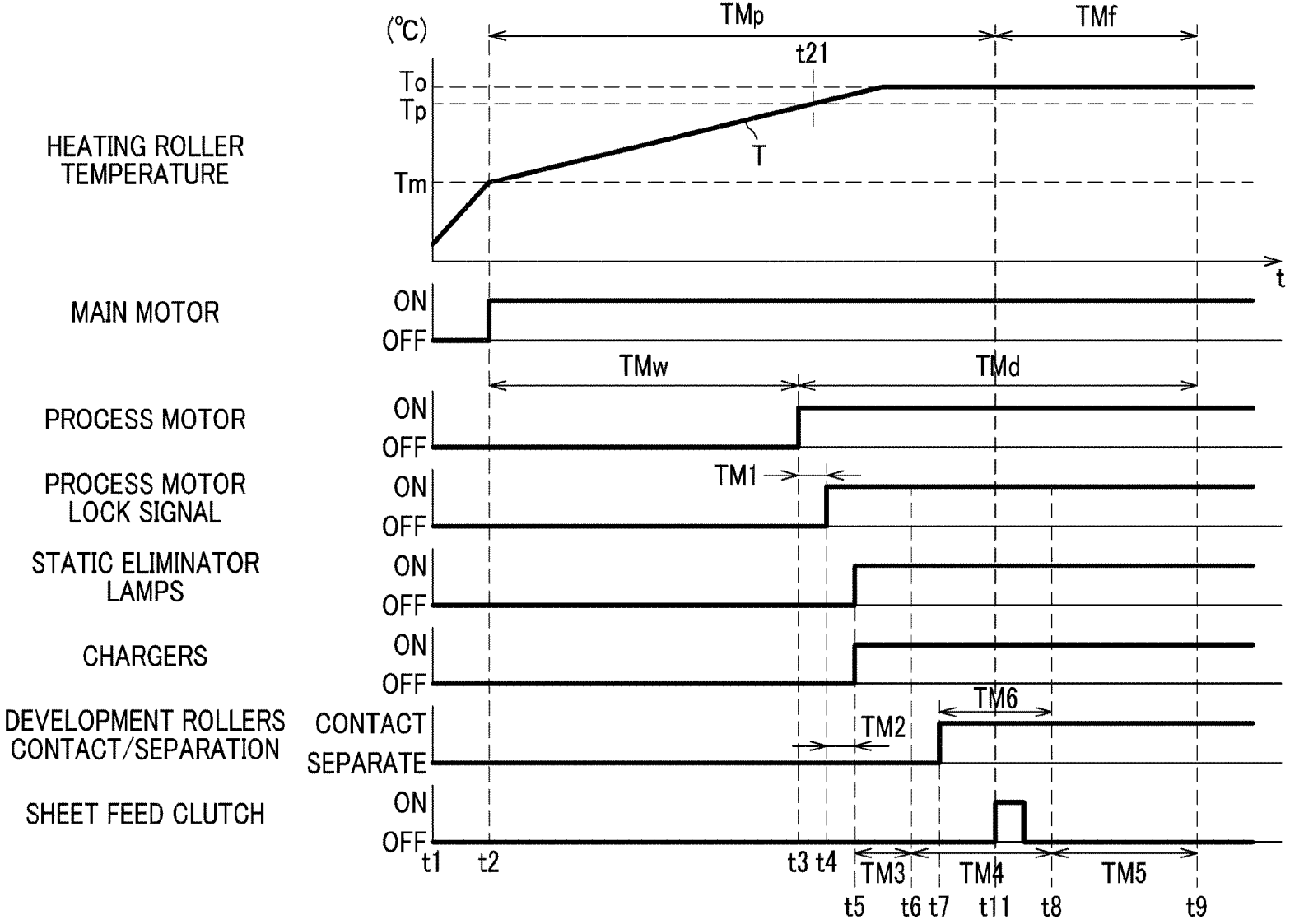
FIG. 6 is a flowchart showing an example in which a detected temperature reaches a pickup permissible temperature during execution of the pre-fixing rotation process.

As shown in FIG. 6, the second execution period TMd includes a first period TM1, a second period TM2, a third period TM3, a fourth period TM4, and a fifth period TM5. The first period TM1 is a time period elapsed from a time of starting of rotation of the process motor M2 until a lock signal for the process motor M2 turns on. The second period TM2 is a time period elapsed from a time of turning-on of the lock signal for the process motor M2 until rotation of the photoconductor drum stabilizes. The third period TM3 is a time period elapsed from a time of starting of supply of the charging bias to the charger 62 by the charging bias supply circuit V until the supply of the charging bias by the charging bias supply circuit V stabilizes. The fourth period TM4 is a time period elapsed from a time of completion of stabilization of the charging bias until the photoconductor drum 61 makes N rotations where N is a natural number indicative of the number of full rotations. The fifth period TM5 is a time period elapsed from a time at which the development roller has been pressed into contact with the photoconductor drum until the development roller 63 makes M rotations where M is a natural number indicative of the number of full rotations. Each of the number of rotations N, M may be set at one or any number more than one. Each of the first period TM1, second period TM2, third period TM3, fourth period TM4 and fifth period TM5 is predetermined as a fixed value determined by means of experiment, simulation, etc. Therefore, the second execution period TMd takes on a fixed value.

The sheet feed process is a process of starting feed of a sheet S if both of a first condition and a second condition are satisfied where the first condition is satisfied if the pre-fixing process has been completed, and the second condition is satisfied if a temperature of the heating roller 81 has become equal to or higher than a predetermined temperature. In the following description, the predetermined temperature will also be called a pickup permissible temperature Tp.

The controller 100 is configured to start the pre-process rotation process when a standby time TMw has elapsed from the time of starting of the pre-fixing rotation process.

The standby time TMw is a value that satisfies the following inequality:

$$A-\alpha \leq TMw \leq A$$

where A=(TMp+TMf)−TMd, TMf is a feed time period from a time of the starting of the feed of a sheet S until a leading edge of the sheet S arrives at the photoconductor drum 61, and α is a time period expended for the photoconductor drum 61 to make a half turn.

Specifically, the controller 100 sets the standby time TMw on the basis of a second table stored in a memory such as RAM. The second table contains a list of items of information on the first execution periods TMp, the feed time periods TMf and the second execution periods TMp, each combination of which is associated with the standby time TMw, showing a relationship between each combination of the periods and the standby time TMw.

Herein, α takes on a fixed value. It is to be understood that α may be changed where appropriate as long as it is not longer than a time period expended for the photoconductor drum 61 to make a half turn. For example, α may be a time period expended for the photoconductor drum 61 to rotate a one-third turn, a one-quarter turn, a one-fifth turn, or through any angle less than 180 degrees. α may be set at 0. That is, A may be equal to TMw (A=TMw). In the present embodiment, the standby time TMw is set with α being 0, to satisfy the equation, TMw=(TMp+TMf)−TMd.

The feed time period TMf takes on a value determined by a distance for a sheet S to be conveyed from the pickup roller 33 to the photoconductor drum 61 (conveyance distance), and a speed at which the sheet S is to be conveyed (conveyance speed).

The conveyance distance from the pickup roller 33 to one photoconductor drum 61 located in a position upstreammost in the direction of conveyance of a sheet S among photoconductor drum(s) 61 used for the image forming process varies with the mode selected, i.e., the conveyance distance in the multicolor mode and the conveyance distance in the monochrome mode are different from each other. To be more specific, the conveyance distance in the multicolor mode is a distance from the pickup roller 33 to the first photoconductor drum 61Y; the conveyance distance in the monochrome mode is a distance from the pickup roller 33 to the second photoconductor drum 61K. Accordingly, the feed time period TMf is set at a value greater in the monochrome mode than in the multicolor mode.

The controller 100 sets the feed time period TMf on the basis of a third table stored in a memory such as RAM. The third table contains information on the feed time periods TMf associated with the modes (the multicolor mode and the monochrome mode), showing a relationship between each of the modes and the feed time period TMf.

Next, a detailed description will be given of an operation of the controller 100 with reference to the flowchart shown in FIG. 4. In the initial state before execution of the process of FIG. 4, the clutches C1, C2 and C3 are disengaged, and the four development rollers 63 are separate from the corresponding photoconductor drums 61.

Figure 4:
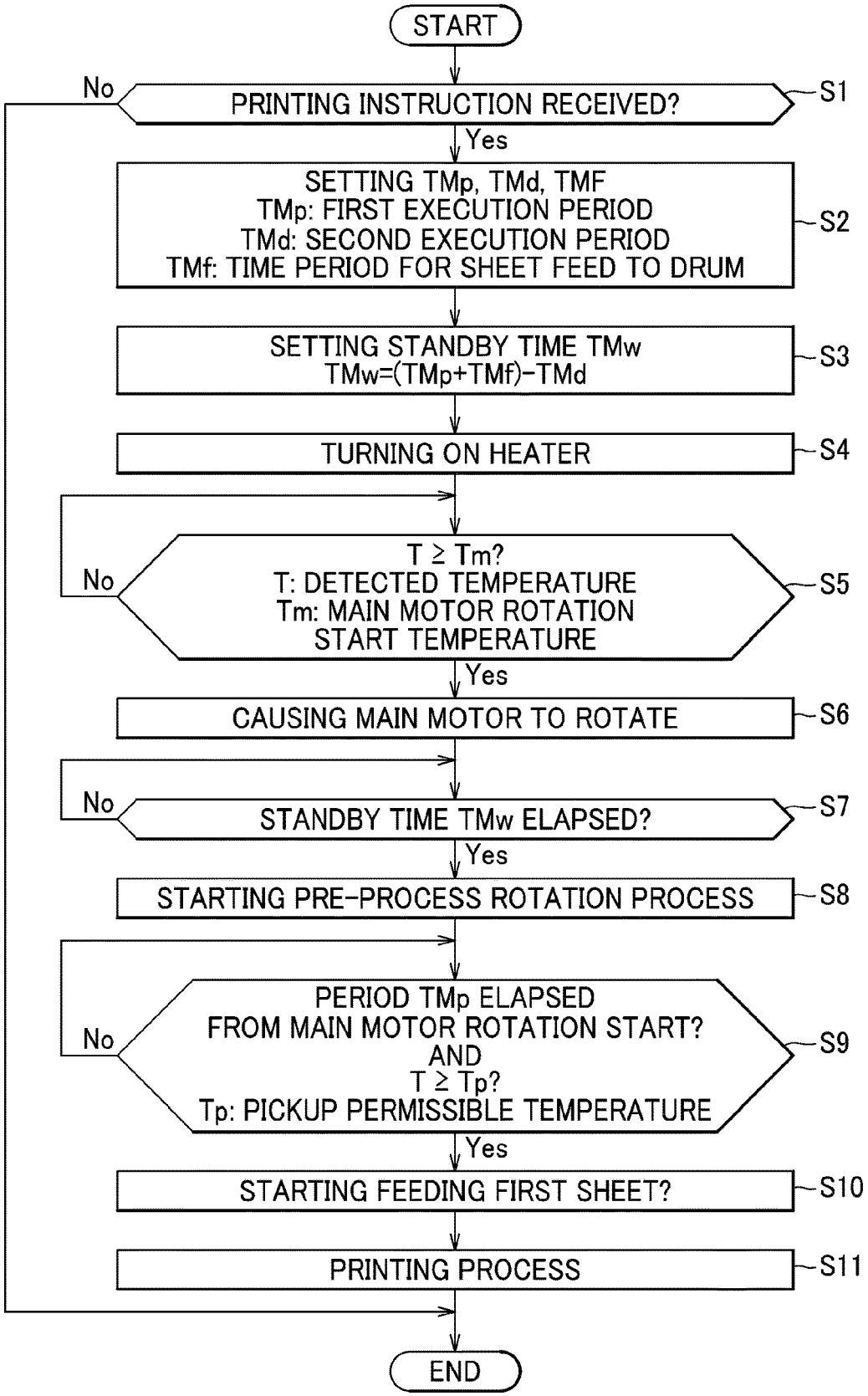
FIG. 4 is a flowchart showing an operation of a controller.

As shown in FIG. 4, the controller 100 first determines whether or not a printing instruction has been received. (S1). If it is determined in step S1 that no printing instruction has been received (No), then the controller 100 brings the process to an end.

If it is determined in step S1 that a printing instruction has been received (Yes), then the controller 100 sets a first execution period TMp, a second execution period TMd, and a feed time period TMf (S2). Specifically, in step S2, the controller 100 sets the first execution period TMp based on the first table. The controller 100 retrieves a fixed value corresponding to the second execution period TMd from the memory and sets the retrieved fixed value as the second execution period TMd. The controller 100 sets a feed time period TMf based on the third table.

After step S2, the controller 100 sets a standby time TMw based on the second table (S3). Specifically, in step 3, the controller 100 sets the standby time TMw which satisfies the equation:

$$TMw=(TMp+TMf)-TMd.$$

After step S3, the controller 100 turns on the heater H (S4), and determines whether or not the temperature T detected by the temperature sensor 83 is equal to or higher than a main motor rotation start temperature Tm (S5). If it is determined in step S5 that T is not equal to or higher than Tm (No), then the controller 100 repeats the process of step S5.

If it is determined in step S5 that T≥Tm (Yes), then the controller 100 starts causing the main motor M1 to operate and starts causing the heating roller 81 to rotate, to thereby start the pre-fixing rotation process (S6). After step S6, the controller 100 determines whether or not the standby time TMw has elapsed from the time of the starting of the pre-fixing rotation process (S7).

If it is determined in step S7 that the standby time TMw has not elapsed yet (No), then the controller 100 repeats the process of step S7. If it is determined in step S7 that the standby time TMw has elapsed (Yes), then the controller 100 starts the pre-process rotation process shown in FIG. 5 (S8).

Figure 5:
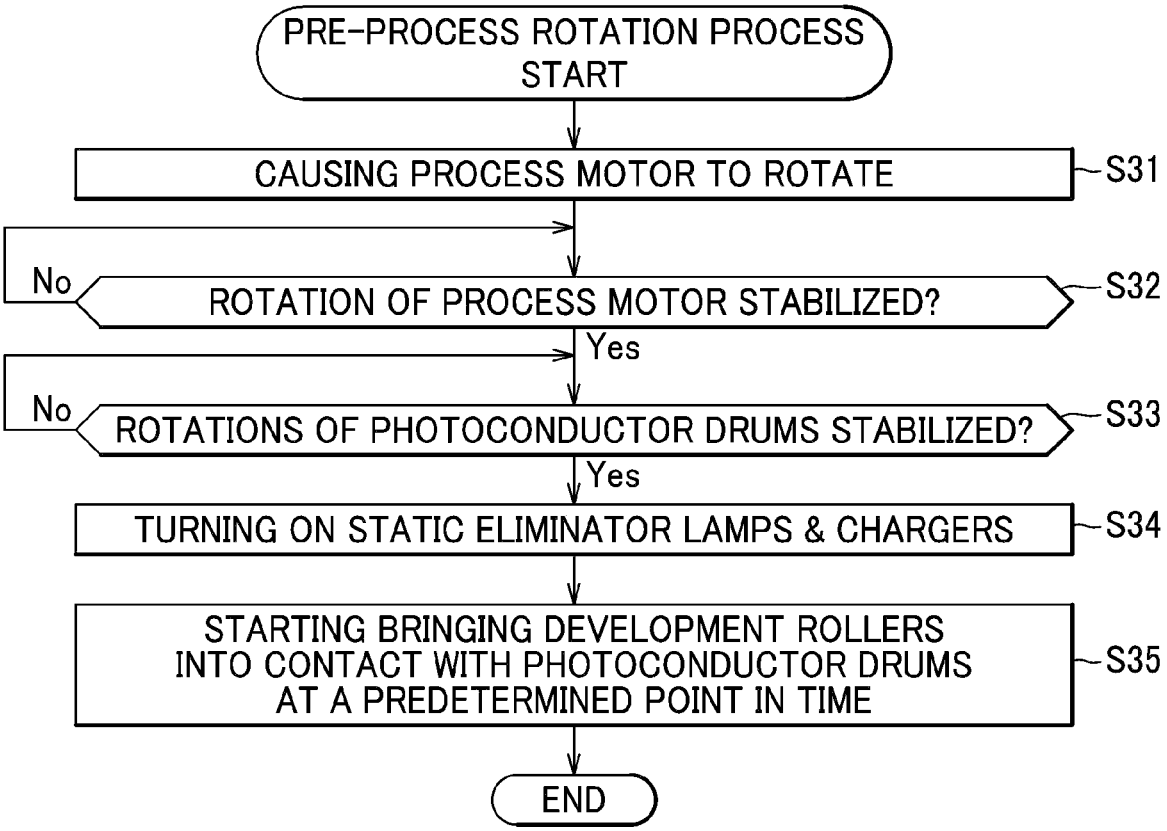
FIG. 5 is a flowchart showing a pre-process rotation process.

As shown in FIG. 5, in the pre-process rotation process, the controller 100 first starts causing the process motor M2 to operate, and causes the development rollers 63Y, 63M and 63C and the photoconductor drums 61 to rotate (S31). In step S31, additionally, the controller 100 turns on the development clutch C2 to cause the development roller 63K to rotate as well.

After step S31, the controller 100 determines whether or not the rotation of the process motor M2 has stabilized (S32). Herein, after the process motor M2 is caused to operate, the rotational speed of the process motor M2 increases, and when the rotational speed of the process motor M2 has reached a predetermined rotational speed, the process motor M2 outputs a process motor lock signal to the controller 100. Upon receipt of the process motor lock signal, the controller 100 determines that the process motor M2 has stabilized.

It is understood that the time period expended from the starting of the rotation of the process motor M2 to the outputting of the process motor lock signal is an approximately fixed period, more specifically, equivalent to the first period TM1 described above, irrespective of the ambient temperature, or the like. Therefore, the controller 100 may be configured to determine, in step S32, whether or not the first period TM1 has elapsed from the time of the starting of the rotation of the process motor M2 to thereby determine whether or not the rotation of the process motor M2 has stabilized.

If it is determined in step S32 that the rotation of the process motor M2 has not stabilized yet (No), then the controller 100 repeats the process of step S32. If it is determined in step S32 that the rotation of the process motor M2 has stabilized (Yes), then the controller 100 determines whether or not the rotations of the photoconductor drums 61 have stabilized (S33). To be more specific, the controller 100 determines, in step S33, whether or not the second period TM2 has elapsed from a time of completion of stabilization of the rotation of the process motor M2 to thereby determine whether or not the rotations of the photoconductor drums 61 have stabilized.

If it is determined in step S33 that the rotations of the photoconductor drums 61 have not stabilized yet (No), then the controller 100 repeats the process of step S33. If it is determined in step S33 that the rotations of the photoconductor drums 61 have stabilized (Yes), then the controller 100 turns on the static eliminator lamps 65, and starts supplying charging biases from the charging bias supply circuits V to the chargers 62 to turn on the chargers 62 (S34).

After step S34, the controller 100 turns on the contact/separation clutch C3 at a predetermined point in time, to start bringing the development rollers 63 into contact with the corresponding photoconductor drums 61 (S35). To be more specific, the contact/separation clutch C3 is turned on at such a point in time that the development rollers 63 being pressed in contact with the photoconductor drums 61 finish making M rotations at a time t8 that is, as shown in FIG. 6, a time just after a lapse of a time period (TM3+TM4) from a time t5 at which the chargers 62 have been turned on. In other words, the turning-on of the contact/separation clutch C3 is timed to complete causing the development rollers 63 to be pressed in contact with the photoconductor drums 61 at a time t7 that is a time just after a lapse of a time period (TM3+TM4−TM6) from the time t5.

At a time t9 that is a time just after a lapse of a time period (TM3+TM4+TM5) from the time t5 at which the chargers 62 have been turned on, the photoconductor drums 61 charged by the chargers 62 with stable charging biases have made N or more rotations, and the development rollers 63 being pressed against the photoconductor drums 61 have made M rotations. Accordingly, the photoconductor drums 61 and the development rollers 63 come to exhibit good conditions suitable for the image forming process; therefore, the pre-process rotation process is completed at the time t9. After the pre-process rotation process is completed (i.e., after the photoconductor drums 61 and the development rollers 63 come to exhibit good conditions suitable for image forming process), the controller 100 may not necessarily bring the pre-process rotation process to an end; rather, after a lapse of time expended for completion of the pre-process rotation process, the controller 100 continues causing the photoconductor drums 61 and the development rollers 63 to rotate and proceeds to a printing process (image forming process) of forming a toner image on a sheet S.

Referring back to FIG. 4, after starting the pre-process rotation process in step S8, the controller 100 determines whether or not both of a first condition and a second condition are satisfied where the first condition is satisfied if the first execution period TMp has elapsed from a time of starting of the main motor M1 and the second condition is satisfied if a temperature T detected by the temperature sensor 83 is equal to or higher than the pickup permissible temperature Tp (S9). If it is determined in step S9 that at least one of the first condition and the second condition is not satisfied (No), then the controller 100 repeats the process of step S9. If it is determined in step S9 that the both of the first condition and the second condition are satisfied (Yes), then the controller 100 turns on the sheet feed clutch C1 to start feeding a first sheet S (S10).

After step S10, the controller 100 causes the image forming unit 4 to perform an image forming process (S11) to print sheets S of which the number is specified in the printing instruction received in step S1, and brings this process of FIG. 4 to an end. At the end of this process, the controller 100 restores the states of the clutches C1, C2 and C3 and the contact/separation mechanism 300 to their initial states.

Next, a detailed description will be given of examples of an operation of the controller 100. In one example shown in FIG. 6, the detected temperature T reaches the pickup permissible temperature Tp during the first execution period TMp for execution of the pre-fixing rotation process.

As shown in FIG. 6, the controller 100, upon receiving the printing instruction (at a time t1), turns on the heater H (not shown). Then, the temperature T of the heating roller 81 increases at a specific rate. When the temperature T of the heating roller 81 reaches the main motor rotation start temperature Tm (at a time t2), the controller 100 turns on the main motor M1 to start the pre-fixing rotation process. When the pre-fixing rotation process is started, the heating roller 81 and the pressure roller 82 are caused to rotate, and the rotating pressure roller 82 absorbs heat from the heating roller 81. Accordingly, the temperature T of the heating roller 81 increases at a rate lower than the aforementioned specific rate.

In the example of FIG. 6, the temperature T of the heating roller 81 reaches the pickup permissible temperature Tp at a time t21 preceding a time t11 of completion of the pre-fixing rotation process. If the temperature T of the heating roller 81 reaches the pickup permissible temperature Tp, the second condition is satisfied; however, at the time t21, the first condition has not been satisfied yet. Therefore, the controller 100 does not start feeding of a sheet S at this time t21. When the temperature T reaches the fixing temperature To, the controller 100 controls the heater H so as to keep the temperature T at the fixing temperature To.

When the standby time TMw has elapsed from the time t2 of starting the pre-fixing rotation process (i.e., at a time t3), the controller 100 turns on the process motor M2 to start the pre-process rotation process. Accordingly, the photoconductor drums 61 are caused to start rotating. At the time t3, as described above, the controller 100 does not only turn on the process motor M2, but also turns on the development clutch C2 to cause the development rollers 63 to rotate.

When the first period TM1 has elapsed from the time t3, the rotation of the process motor M2 stabilizes (at a time t4). When the second period TM2 has elapsed from the time t4, the rotations of the photoconductor drums 61 stabilize (at a time t5).

When a time period (TM1+TM2) has elapsed from the time t3 (i.e., at the time t5), the controller 100 turns on the static eliminator lamps 65, and turns on the chargers 62. When the third period TM3 has elapsed from the time t5, the charging biases supplied to the chargers 62 stabilize (at a time t6).

At a predetermined time after the time t6, the controller 100 turns on the contact/separation clutch C3 (at a time t7). When the first execution period TMp has elapsed from the time t2 of starting the pre-fixing rotation process (i.e., at a time t11), the first condition is satisfied; therefore, the controller 100 turns on the sheet feed clutch C1 to start feeding a sheet S.

When the fourth period TM4 has elapsed (i.e., the photoconductor drums 61 have made N rotations) from the time t6 at which the charging biases have stabilized (i.e., at a time t8), the development rollers 63 brought into contact with the corresponding photoconductor drums 61 at the time t7 have made M rotations while being pressed against the corresponding photoconductor drums 61. When the fifth period TM5 has elapsed (i.e., the development rollers 63 pressed against the corresponding photoconductor drums 61 have made M rotations) from the time t8 (i.e., at a time t9), the photoconductor drums 61 and the development rollers 63 come to exhibit good conditions suitable for the image forming process, and the pre-process rotation process comes to an end. In short, the pre-process rotation process is completed after a lapse of a time period (TMw+TMd) from the time t2 of the starting of the pre-fixing rotation process.

On the other hand, the leading edge of a sheet S started being fed at the time t11 arrives at the photoconductor drum 61 (at the time t9) after a lapse of the feed time period TMf from the time t11. In other words, if the detected temperature T reaches the pickup permissible temperature Tp during the first execution period TMp, the leading edge of the sheet S arrives at the photoconductor drum 61 (at the time t9) after a lapse of a time period (TMp+TMf) from the time t2 of the starting of the pre-fixing rotation process.

The standby time TMw is set at a time period which satisfies the equation TMw=(TMp+TMf)−TMd, as described above. Therefore, the time period (TMw+TMd) elapsed from the time t2 of starting the pre-fixing rotation process until completion of the pre-process rotation process is equal to the time period (TMp+TMf) elapsed from the time t2 of starting the pre-fixing rotation process until arrival of the leading edge of a sheet S at the photoconductor drum 61. Accordingly, the pre-process rotation process is determined to get completed at a time when the leading edge of the sheet S arrives at the photoconductor drum 61, and thus, unnecessary rotation the photoconductor drum 61 would make after receipt of the printing instruction before the leading edge of the sheet S arrives at the photoconductor 61 can be reduced.

Figure 7:
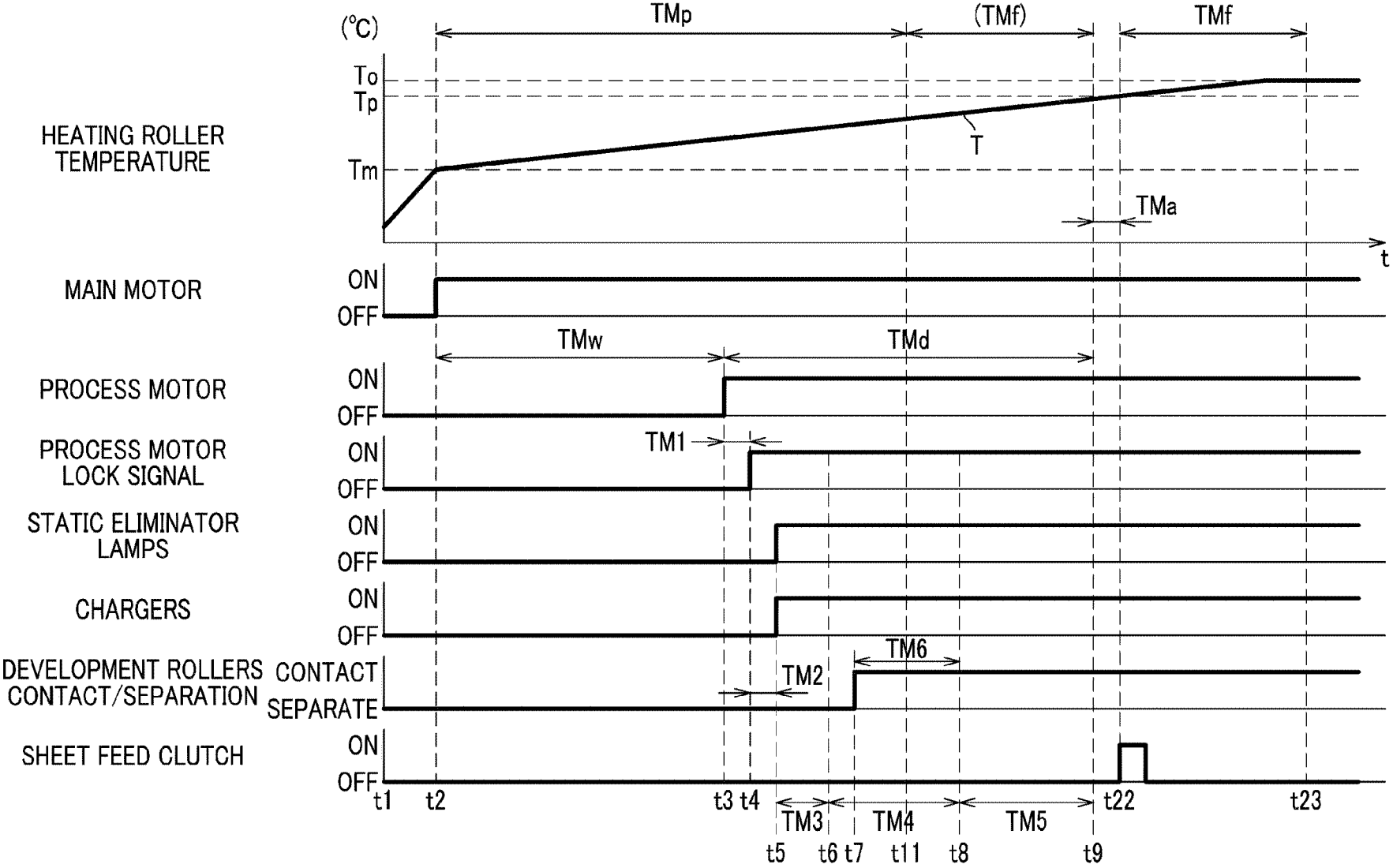
FIG. 7 is a time chart showing an example in which a detected temperature reaches a pickup permissible temperature after completion of the pre-fixing rotation process.

In another example shown in FIG. 7, the detected temperature T reaches the pickup permissible temperature Tp after completion of the pre-fixing rotation process. The example of FIG. 7 differs from the example of FIG. 6 only in the timing of starting the feed of a sheet S, and the following process to be executed in the example of FIG. 7 is substantially the same as that of FIG. 6.

In the example of FIG. 7, the temperature T of the heating roller 81 reaches a pickup permissible temperature Tp (at a time t22) when a time period (TMp+TMf+TMa) which is longer than the first execution period TMp has elapsed from the time t2. Therefore, at the time t22, the controller 100 turns on the sheet feed clutch C1, and start feeding a sheet S. In this instance, the photoconductor drum 61 rotates unnecessarily during a time period (TMa+TMf) from the time t9 of completion of the pre-process rotation process (the end of the second execution period TMd) to a time t23 at which the leading edge of a sheet S arrives at the photoconductor drum 61. However, in the example of FIG. 7 as well, the photoconductor drums 61 are not caused to rotate during the standby time TMw; therefore, unnecessary rotation of the photoconductor drums 61 can be reduced in comparison, for example, with a configuration in which the pre-fixing rotation process and the pre-process rotation process are caused to start at the same time.

In the present embodiment as described above, the following advantageous effects can be achieved.

If the temperature T of the heating roller 81 reaches the pickup permissible temperature Tp before completion of the pre-fixing rotation process, the pre-process rotation process is completed at a time when the leading edge of a sheet S arrives at the photoconductor drum 61; thus, unnecessary rotation of the photoconductor drums 61 can be reduced.

The above-described embodiment may be modified and implemented in various forms as will be described below.

In the above-described embodiment, the color printer 1 is given as an example of an image forming apparatus; however, the image forming apparatus may be a monochrome printer, or other apparatus such as a copier, a multifunction peripheral, etc. In an alternative embodiment, such as a monochrome printer, without any means for rendering a development roller movable between the contact position and the separate position, the second execution period TMd may not include the fifth period TM5 (time period necessary for the development roller to make M rotations).

Parameters such as the first execution period TMp may not be set based on the tables as described above, but may be, for example, computed using predetermined formulae.

The elements described in the above embodiment and its modified examples may be implemented selectively and in combination.

What is claimed is:

1. An image forming apparatus comprising:

a sheet feed mechanism provided to feed a sheet;

a conveyor belt provided to convey the sheet fed by the sheet feed mechanism in a direction of conveyance of the sheet;

a first photoconductor drum provided to form a toner image of a first color on the sheet conveyed by the conveyor belt;

a second photoconductor drum provided to form a toner image of a second color on the sheet conveyed by the conveyor belt, the second photoconductor drum being located downstream of the first photoconductor drum in the direction of conveyance of the sheet;

a heating member configured to heat a sheet, the heating member being rotatable; and a controller configured to be operated in one of selectable modes including a multicolor mode in which a toner image is formed using both of toner of the first color and toner of the second color and a monochrome mode in which a toner image is formed using toner of the second color only, wherein the controller is configured to exercise, upon receipt of a printing instruction, control which comprises:

starting rotation of the heating member;

starting rotation of the first and second photoconductor drums when a first standby time has elapsed from a time of the starting of the rotation of the heating member if the controller is operated in the monochrome mode, or when a second standby time longer than the first standby time has elapsed from the time of the starting of the rotation of the heating member if the controller is operated in the multicolor mode;

causing the sheet feed mechanism to feed a sheet after the starting of the rotation of the first and second photoconductor drums; and forming a toner image on the sheet after causing the sheet feed mechanism to feed the sheet.

2. The image forming apparatus according to claim 1, wherein the controller is configured to determine whether or not a first condition is satisfied and whether or not a second condition is satisfied, and to cause the sheet feed mechanism to feed a sheet if both of the first condition and the second condition are satisfied, where the first condition is satisfied if a first execution period has elapsed from a time of the starting of the rotation of the heating member, and the second condition is satisfied if a temperature of the heating member has become equal to or higher than a predetermined temperature.

3. The image forming apparatus according to claim 2, wherein the controller is configured to change the first execution period according to a type of the sheet.

4. The image forming apparatus according to claim 2, wherein the controller is configured to change the first execution period according to an ambient temperature.

5. The image forming apparatus according to claim 1, further comprising a first motor that causes the heating member to rotate, wherein the controller is configured to start operation of the first motor to start the rotation of the heating member.

6. The image forming apparatus according to claim 1, further comprising a second motor that causes the first and second photoconductor drums to rotate, wherein the controller is configured to start operation of the second motor to start the rotation of the first and second photoconductor drums.

7. The image forming apparatus according to claim 1, wherein the controller is configured to start causing the heating member to be heated upon receipt of the printing instruction, and start causing the heating member to rotate upon detection that a temperature of the heating member has become equal to or higher than a rotation start temperature.

8. An image forming apparatus comprising:

a photoconductor drum provided to form a toner image on a sheet;

a heating member configured to heat a sheet, the heating member comprising a heating roller that is rotatable; and a controller configured to execute, upon receipt of a printing instruction, processes comprising:

a heating process of heating the heating roller;

a pre-fixing rotation process of starting rotation of the heating roller and causing the heating roller to rotate for a first execution period TMp from a time of the starting of the rotation of the heating roller;

a pre-process rotation process of starting rotation of the photoconductor drum when a standby time TMw has elapsed from the time of the starting of the rotation of the heating roller and causing the photoconductor drum to rotate for a second execution period TMd from a time of starting of rotation of the photoconductor drum, the second execution period TMd being shorter than the first execution period TMp; and a sheet feed process of starting feed of a sheet if both of a first condition and a second condition are satisfied where the first condition is satisfied if the pre-fixing rotation process has been completed, and the second condition is satisfied if a temperature of the heating roller has become equal to or higher than a predetermined temperature, wherein the standby time TMw satisfies an equation:

$$TMw=(TMp+TMf)-TMd$$

where TMf is a time period from a time of the starting of the feed of the sheet until a leading edge of the sheet arrives at the photoconductor drum.

9. The image forming apparatus according to claim 8, wherein the controller is configured to be operated in one of selectable modes including a multicolor mode in which a toner image is formed using both of toner of a first color and toner of a second color and a monochrome mode in which a toner image is formed using toner of the second color only, wherein in the multicolor mode, TMw is obtained with the time period TMf having a first duration, and in the monochrome mode, TMw is obtained with the time period TMf having a second duration, the second duration being longer than the first duration.

10. A method of control implemented in an image forming apparatus including a sheet feed mechanism provided to feed a sheet, a conveyor belt provided to convey the sheet fed by the sheet feed mechanism in a direction of conveyance of the sheet, a first photoconductor drum provided to form a toner image of a first color on the sheet conveyed by the conveyor belt, a second photoconductor drum provided to form a toner image of a second color on the sheet conveyed by the conveyor belt, the second photoconductor drum being located downstream of the first photoconductor drum in the direction of conveyance of the sheet, and a heating member configured to heat a sheet, the heating member being rotatable, the control being exercised in one of selectable modes including a multicolor mode in which a toner image is formed using both of toner of the first color and toner of the second color and a monochrome mode in which a toner image is formed using toner of the second color only, wherein the method to be executed upon receipt of a printing instruction comprises:

starting rotation of the heating member;

starting rotation of the first and second photoconductor drums when a first standby time has elapsed from a time of the starting of the rotation of the heating member if the controller is operated in the monochrome mode, or when a second standby time longer than the first standby time has elapsed from the time of the starting of the rotation of the heating member if the controller is operated in the multicolor mode;

causing the sheet feed mechanism to feed a sheet after the starting of the rotation of the first and second photoconductor drums; and forming a toner image on the sheet after causing the sheet feed mechanism to feed the sheet.

* * * * *